United States Patent [19]

Lawrence

[11] Patent Number: 4,930,749

[45] Date of Patent: Jun. 5, 1990

[54] STAPLE REMOVER WITH ADJUSTABLE LEVERAGE

[76] Inventor: Robert S. Lawrence, 344 State St., Fairfield, Calif. 94533

[21] Appl. No.: 352,160

[22] Filed: May 15, 1989

[51] Int. Cl.[5] ..... B25C 11/00

[52] U.S. Cl. ..... 254/28

[58] Field of Search ..... 254/28, 25, 26 E, 129, 254/131, 104, 11, 17; 29/267, 239; 7/166

[56] References Cited

U.S. PATENT DOCUMENTS

| | | | |
|---|---|---|---|
| 119,770 | 10/1871 | Ives | 254/25 |
| 2,563,227 | 8/1951 | Emery | 254/28 |
| 3,310,288 | 3/1967 | Berry | 254/28 |
| 3,613,134 | 10/1971 | Bassett | 254/28 |
| 4,036,471 | 7/1977 | Allen et al. | 254/28 |
| 4,049,236 | 11/1977 | Grill et al. | 254/28 |
| 4,205,823 | 6/1980 | Goldy | 254/28 |
| 4,219,187 | 8/1980 | Brumfield | 254/28 |
| 4,688,761 | 8/1987 | Wilcox | 254/104 |

OTHER PUBLICATIONS

Osborne & Co., from Ad in "The Professional Upholsterer", Magazine Dtd., Jun./Jul. 1988.

*Primary Examiner*—Robert C. Watson

[57] ABSTRACT

A tool having a generally horizontal U shaped shaft, the upper portion thereof having a handle attached thereto, and the lower portion of said shaft ending with an upwardly curved blade which tapers to a thin, sharp edge slightly forward of two side tines which are upwardly curved in an arc similar to that of the blade except that said arc turns conversely near the vertices of said side tines so as to form convergences wherein the blade and the side tines, jointly, can engage, grip, and lift a staple from its embedment. An adjustable leverage means is mounted on the lower portion of said shaft so as to provide lift as required to extract staples of various sizes from their embedments.

4 Claims, 2 Drawing Sheets

STAPLE REMOVER WITH ADJUSTABLE LEVERAGE

BACKGROUND OF THE INVENTION

1. Field of the Invention

This invention relates to staple pullers, and more particularly, to manually operated devices for removing U shaped staples from their embedments.

2. Description of the Prior Art

Numerous devices are known in the art for removing embedded U shaped staples such as are encountered in the upholstery trade.

A tool, currently popular among upholsterers, disclosed in U.S. Pat. No. 3,310,288 can partially lift a staple from its embedment, but it usually requires another tool such as a pair of pliers to complete the extraction of the staple. A staple remover disclosed in U.S. Pat. No. 4,049,236 requires a blow from another tool such as a mallet to effect the removal of a staple. U.S. Pat. No. 4,036,471 discloses a device, not usable ambidexterously, that can cause staples to fly erratically on extraction, thus creating a safety hazzard to persons in the work area. U.S. Pat. No. 4,219,187 discloses a device for removing large clinched staples from cardboard boxes, but such a device is not suitable for removing U shaped upholstery staples from their embedments.

None of these devices provides a means of restricting the user's hand from contact with the work surface and possible lacerations or abrasions therefrom, nor do they have a means for adjusting leverage so as to provide lift as required to effect the removal of staples of various sizes from their embedments.

SUMMARY OF THE INVENTION

It is an object of this invention to provide a staple remover which is safer, more versatile, and more efficient than the prior art, and which is operable ambidexterously.

This objective is preferably accomplished by providing a staple remover having a shaft formed so as to have generally parallel upper and lower portions spaced and interconnected by a verticle portion thereof. The upper portion of said shaft is shorter than the lower portion and has a handle attached thereto for holding the tool, thus the lower portion of the shaft can inhibit the user's hand from contact with the work surface. The lower portion of the shaft terminates with an upwardly curved blade which tapers to a thin, sharp edge located slightly forward of two side tines which are upwardly curved in an arc similar to that of the blade except that the curvature of said arc turns conversely near the vertices of said side tines, thus forming convergences wherein the blade and the side tines, jointly, can engage, grip and lift a staple from its embedment. The side tines are provided with downward projections at their termini, so as to deflect flying staples towards the work surface and away from the user or other persons who may be in the proximity. The lower portion of the staple remover shaft is provided with an adjustable leverage means which is easily movable and securable along said shaft as well as completely removable therefrom so as to provide leverage and lift as required to remove staples of various sizes from their embedments.

DRAWING REFERENCE NUMERAL NOMENCLATURE

10: Shaft
12: Handle
14: Blade
16, 18: Side tines
20, 22: Convergences
24, 26: Projections
28: Staple
30: Apertures and fasteners
32: Leverage means
34, 36: Protrusions
38, 40: Apertures for Shaft
42: Apex
44: Bridge
45: Threaded aperture
46: Set screw.

DESCRIPTION OF THE PREFERRED EMBODIMENT

Figure 1:
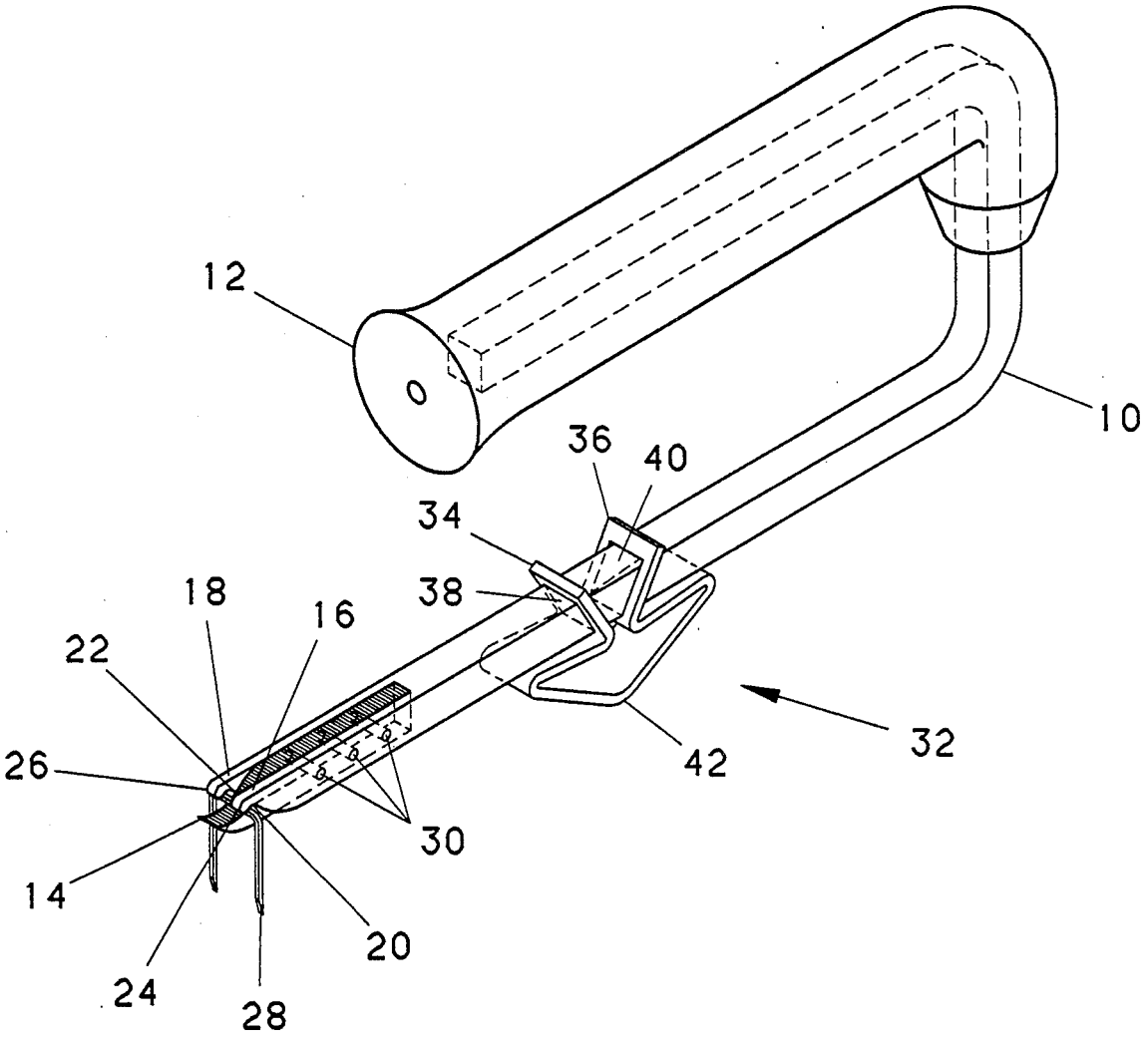
FIG. 1 is an isometric view of the preferred embodiment of the staple remover.
Figure 2:
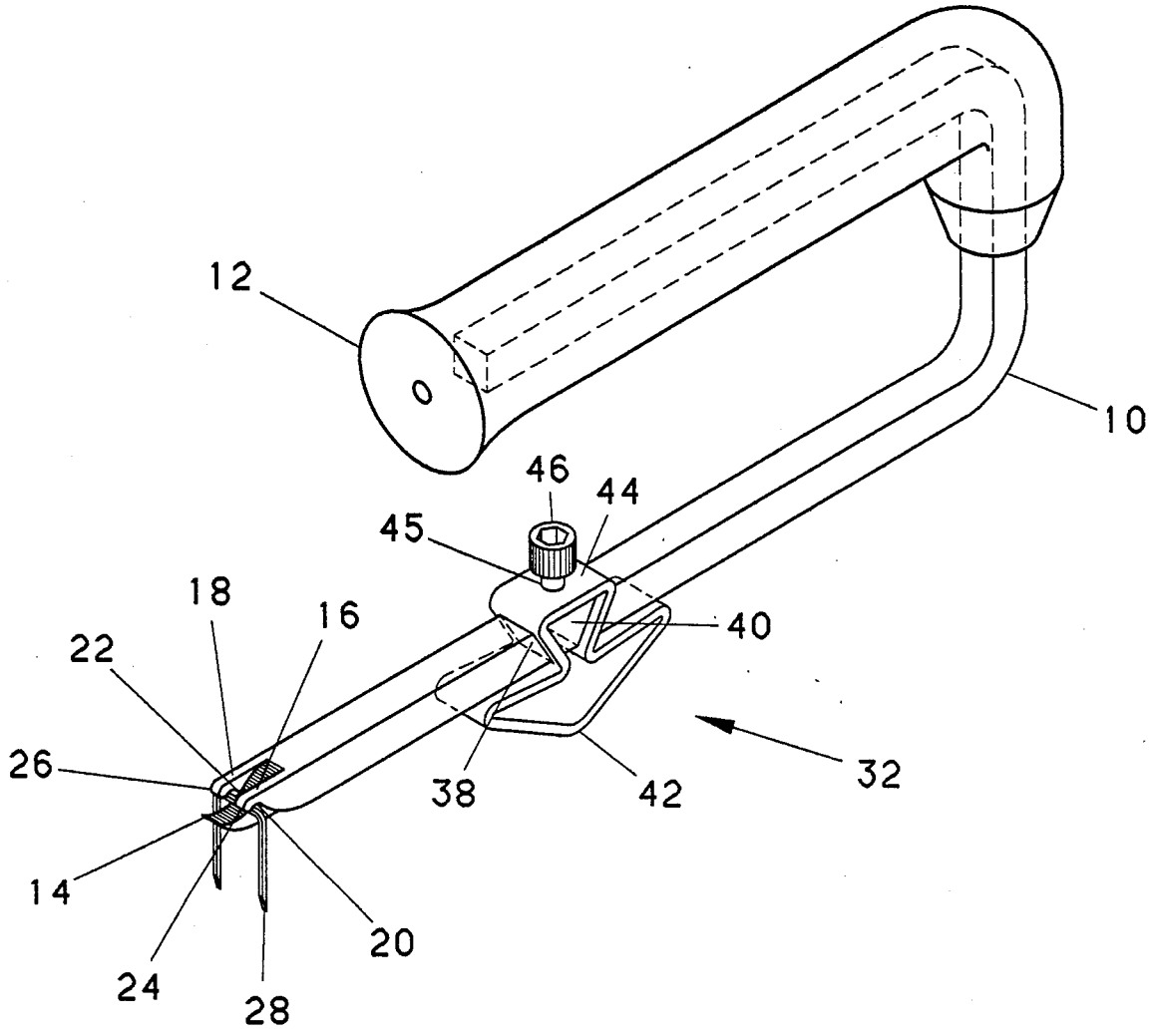
FIG. 2 is an isometric view of an alternate embodiment of the staple remover.

As seen in FIG. 1 which depicts the preferred embodiment of the tool in its usual operating position, the staple remover comprises a rectangular, generally horizontal U shaped shaft 10, the upper portion thereof being shorter than, and generally parallel with, the lower portion. Said shaft may be fabricated from a sturdy metal or other suitable material. A handle 12 is attached to the upper portion of the shaft so as to provide an effective and comfortable grip for the user's hand, thus the lower portion of the shaft can inhibit the user's hand from contact with the work surface and possible injury therefrom. The shaft 10 has an elongated lower portion which terminates with a blade portion 14 situated between, and slightly forward of, two side tines 16,18. Said blade and said side tines may be machined from a solid shaft as is seen in FIG. 2 or, as preferred in FIG. 1, the blade may be removable from the shaft for sharpening or replacement. The removable blade portion may be secured to the shaft 10 by appropriate fasteners in multiple aligned apertures 30 provided in said shaft and said blade. The blade 14 is upwardly curved and tapered to a thin, sharp edge so as to allow it to be easily inserted under, and thus cradle the bridge of an embedded staple 28. The side tines 16, 18 are upwardly curved in an arc similar to that of the blade 14 except that said arc turns conversely near the vertices of said side tines, thus forming convergences 20,22 with the blade 14 wherein said blade and said side tines, jointly, can engage, grip and lift a staple 28 from its embedment. The side tines are provided with downward projections 24,26 at their termini for deflecting, toward the work surface, and away from the user or persons in the proximity, staples that have a tendency to fly on extraction.

In the preferred embodiment of FIG. 1, a triangular shaped leverage means 32 is mounted on the shaft 10 with its apex situated on the underside of the lower portion of said shaft. Said leverage means has two upwardly extending protrusions 34,36 which are provided with appropriatly elongated apertures 38,40 for receiving the shaft 10 therein. In the preferred embodiment of FIG. 1, said leverage means is fabricated from a suitable spring material. Hence, the tension and friction which hold the leverage means in place on the shaft can be relieved by squeezing the protrusions 34,36 together, thereby permitting said leverage means to be easily moved to any desired location on the lower portion of said shaft, or to easily be completely removed therefrom. Another embodiment of a leverage means is seen in FIG. 2 wherein the leverage means 32 is provided with a bridge 44 that connects what would have been the protrusions 34,36 of FIG. 1. Said bridge is provided with a threaded aperture 45 for receiving a set screw 46 therein for securing the leverage means in a desired location on the lower portion of the shaft 10.

In operation, the leverage means 32 is set at a desired location on the shaft 10. The staple remover is held by the handle 12, and the blade 14 is inserted under the bridge of an embedded staple 28 contiguously with the rotation of the shaft about the apex 42 of the leverage means 32 towards the work surface, Thus causing said staple to become gripped in the convergences 20,22 of the blade 14 and the side tines 16,18 and to be lifted thereby from its embedment.

It can now be seen that a unique staple remover has been disclosed. While the invention is primarily directed to the removal of U shaped upholstery staples, variations in the preferred embodiment, such as changes in dimensions, shapes, or fabrication materials which would make the invention suitable for other uses such as removing tacks, nails, clip fasteners, or heavy staples such as are used in the construction trades may occur to persons skilled in the art. Therefore, it should be recognized that changes may be made without departing from the scope of the appended claims.

I claim:

1. A staple remover comprising:

a shaft formed so as to have generally horizontal and generally parallel upper and lower portions which are spaced and interconnected by a verticle portion thereof;

a handle fastened to the upper portion of said shaft;

an upwardly curved blade which tapers to a thin, sharp edge at the end of the lower portion of the shaft;

a pair of side tines located on opposite sides of, and slightly aft of said blade, said side tines being upwardly curved in an arc similar to that of the blade except that the curvature of said arc turns conversely near the vertices of the side tines, said side tines ending slightly forward of said vertices with downward projections at their termini and;

an adjustable leverage means mounted on the lower portion of the shaft with the apex of said leverage means situated on the underside of the shaft;

whereby insertion of the blade of the staple remover under the bridge of an embedded staple contiguously with the exertion of pressure on the handle toward the work surface and rotation of the shaft about the apex of the leverage means can cause said staple to become gripped in the convergences of said blade and said side tines and be lifted thereby from its embedment, and thence be deflected toward the work surface.

2. The staple remover of claim 1 wherein the blade is removable from the shaft.

3. The staple remover of claim 1 wherein the adjustable leverage means is fabricated from a spring material.

4. The staple remover of claim 1 wherein a mechanical means is provided for securing the leverage means in a desired location on the shaft.

* * * * *